US011751747B2

(12) United States Patent
Anim-Mensah et al.

(10) Patent No.: US 11,751,747 B2
(45) Date of Patent: Sep. 12, 2023

(54) WAREWASH MACHINE ENERGY CONSERVATION INCORPORATING VENT CONTROLS

(71) Applicant: ILLINOIS TOOL WORKS INC., Glenview, IL (US)

(72) Inventors: Alexander R. Anim-Mensah, Miamisburg, OH (US); Mary E. Paulus, Sidney, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 334 days.

(21) Appl. No.: 17/046,913

(22) PCT Filed: Apr. 18, 2019

(86) PCT No.: PCT/US2019/028087
§ 371 (c)(1),
(2) Date: Oct. 12, 2020

(87) PCT Pub. No.: WO2019/209620
PCT Pub. Date: Oct. 31, 2019

(65) Prior Publication Data

US 2021/0145245 A1 May 20, 2021

Related U.S. Application Data

(60) Provisional application No. 62/661,737, filed on Apr. 24, 2018.

(51) Int. Cl.
*A47L 15/24* (2006.01)
*A47L 15/42* (2006.01)
(Continued)

(52) U.S. Cl.
CPC ..... *A47L 15/4291* (2013.01); *A47L 15/241* (2013.01); *A47L 15/4287* (2013.01);
(Continued)

(58) Field of Classification Search
None
See application file for complete search history.

(56) References Cited

U.S. PATENT DOCUMENTS 9,510,728 B2 12/2016 Tuller
2007/0125403 A1 6/2007 Ecker
(Continued)

FOREIGN PATENT DOCUMENTS

DE 102015222959 12/2016
EP 1708606 10/2006
(Continued)

OTHER PUBLICATIONS

PCT, International Search Report and Written Opinion, International Application No. PCT/US2019/028087; dated Jul. 16, 2019, 12 pages.

*Primary Examiner* — Levon J Shahinian
(74) *Attorney, Agent, or Firm* — THOMPSON HINE LLP

(57) ABSTRACT

A warewash machine includes a housing defining a ware inlet, a ware outlet and an internal chamber including a plurality of sequential spray zones including at least one wash zone and a rinse zone downstream of the wash zone in a ware conveyance direction. A vent path leads from the chamber leading to a vent outlet for connecting to a building ventilation system. A damper is provided for controlling a flow area at a location along the vent path. A controller is connected to control a position of the damper, the controller configured to adjust a position of the damper based upon input from at least a first temperature sensor, wherein the first temperature sensor is located at one of (i) the ware inlet, (ii) the ware outlet or (iii) along the vent path. Methods of operating a warewash machine are also provided.

17 Claims, 1 Drawing Sheet

(51) Int. Cl.
*A47L 15/46* (2006.01)
*A47L 15/48* (2006.01)

(52) U.S. Cl.
CPC ..... *A47L 15/46* (2013.01); *A47L 15/486* (2013.01); *A47L 15/488* (2013.01); *A47L 2401/18* (2013.01); *A47L 2501/10* (2013.01); *A47L 2501/12* (2013.01)

(56) References Cited

U.S. PATENT DOCUMENTS

| | | | | |
|---|---|---|---|---|
| 2016/0143507 | A1* | 5/2016 | Tuller | A47L 15/4257 134/107 |
| 2017/0027408 | A1 | 2/2017 | Paulus | |

FOREIGN PATENT DOCUMENTS

| | | |
|---|---|---|
| JP | 4614360 | 1/2011 |
| JP | 5568656 | 8/2014 |
| WO | WO 2005070276 | 8/2005 |

* cited by examiner

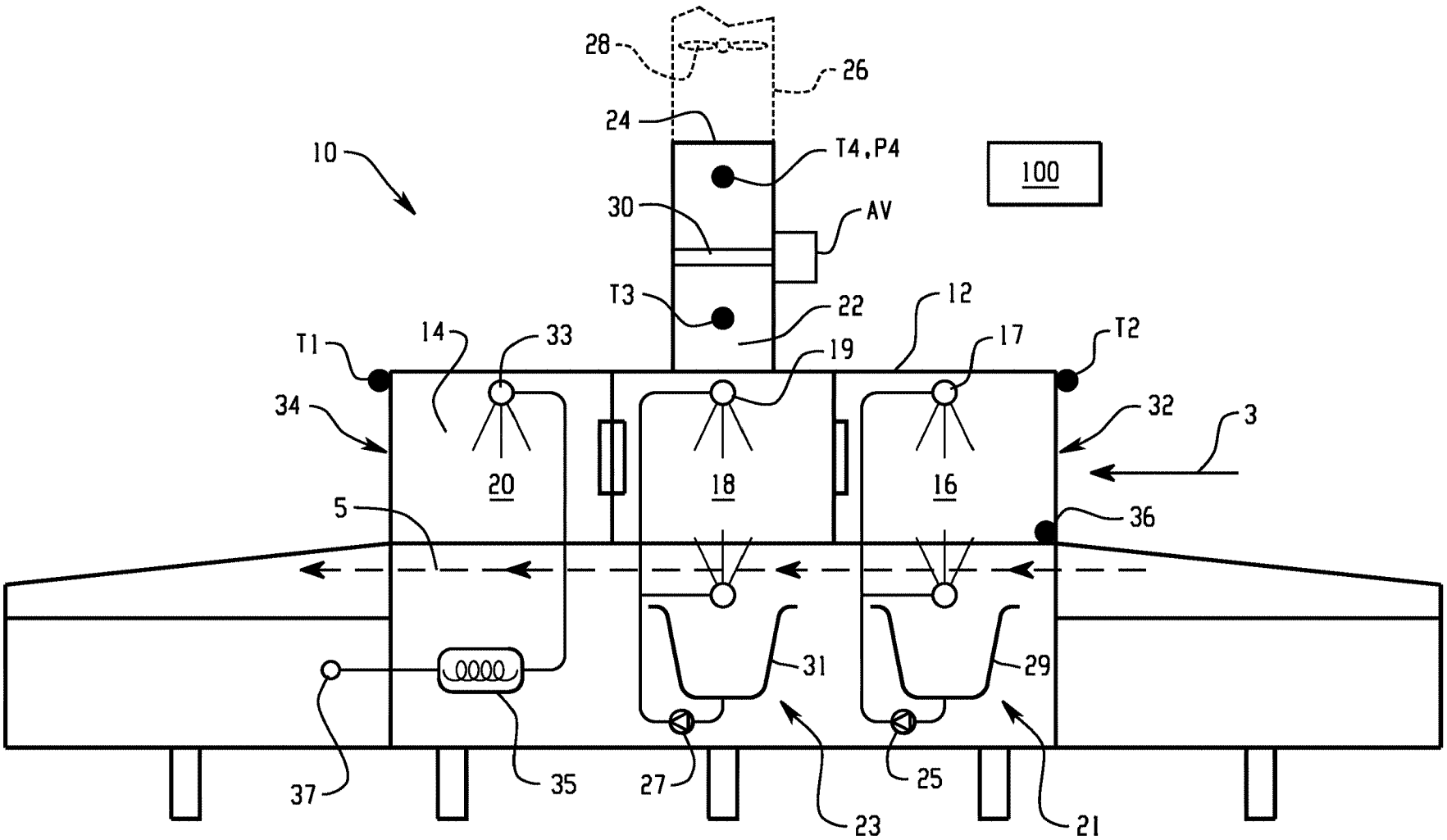
100
3
32
36
T2
17
12
16
21
29
25
26
T4,P4
AV
22
19
23
31
18
27
28
24
30
T3
33
20
35
14
10
T1
34
5
37

WAREWASH MACHINE ENERGY CONSERVATION INCORPORATING VENT CONTROLS

TECHNICAL FIELD

This application relates generally to warewash machines such as those used in commercial applications such as cafeterias and restaurants and, more specifically, to vented warewash machines.

BACKGROUND

Commercial warewashers commonly include a housing area which defines washing and rinsing zones for dishes, pots, pans and other wares. Larger machines may have vent outlets connected to the building ventilation system. Air is drawn from inside the machine by a building vent fan through the vent and exhausted in order to limit spillover of hot moist air into the room environment in which the warewasher is operating. However, heat losses from warewash machines through the vents can be significant.

It would be desirable to provide a warewash machine with reduced energy losses through ventilation systems.

SUMMARY

In one aspect, a warewash machine includes a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction. A vent path leads from the chamber leading to a vent outlet for connecting to a building ventilation system. A damper is provided for controlling a flow area at a location along the vent path. A controller is connected to control a position of the damper, the controller configured to adjust a position of the damper based upon input from at least a first temperature sensor, wherein the first temperature sensor is located (i) proximate to the ware inlet, (ii) proximate to the ware outlet or (iii) along the vent path.

In another aspect, a method of operating a warewash machine to reduce energy loss is provided, wherein the warewash machine includes a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction, a vent path from the chamber leading to a vent outlet for connecting to a building ventilation system, a damper for controlling a flow area at a location along the vent path, and a first temperature sensor, wherein the first temperature sensor is located (i) proximate to the ware inlet, (ii) proximate to the ware outlet or (iii) along the vent path, and the method involves adjusting a position of the damper based upon a temperature indicated by the first temperature sensor.

In still another aspect, a warewash machine includes a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction. A vent path leads from the chamber leading to a vent outlet for connecting to a building ventilation system. A damper is provided for controlling a flow area at a location along the vent path. A controller is connected to control a position of the damper, the controller configured to adjust a position of the damper based upon input from at least one temperature sensor that indicates a temperature condition proximate at least one of the ware inlet or the ware outlet, or along the vent path.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 1 is a schematic side elevation of a warewash machine.

DETAILED DESCRIPTION

Referring to FIG. 1, a warewash machine 10 is shown and includes a housing 12 defining an internal chamber 14, through which wares are moved in a conveyance direction 3 for cleaning, such as by a conveyor 5, such as a continuous loop conveyor or a reciprocating conveyor. The internal chamber 14 includes a plurality of spray zones, such a pre-wash zone 16, a wash zone 18 and a rinse zone 20. The wash zones 16, 18 may, for example, include respective upper and lower spray arms 17, 19 and a recirculation system 21, 23 with a pump 25, 27 to spray wash liquid from a tank 29, 31 below the conveyance path. The rinse zone 20 includes spray arms 33 for spraying rinse liquid from a source such as a booster heater 35 that receives water from a fresh water input 37. The number and extent of the spray zones can vary widely, and additional zones, such as a drying zone, can also be provided.

The machine 10 includes a vent path 22 from the chamber 14 and leading to a vent outlet 24 for connecting to a building ventilation system 26 that includes its own fan unit 28 that draws air from the machine 10. In one example, the fan unit 28 is operated at a constant speed, or any variance of the fan speed is based upon factors unrelated to the operating state or conditions of the machine 10. A damper 30 (here in the form of a motor controlled automated valve AV) is provided for controlling a flow area at a location along the vent path 22.

A controller 100 is connected to control a position of the damper 30 in a manner that saves energy and still prevents undesired spillover of hot moist air from the machine 10 through the inlet and outlet to the chamber and into the environment of the room in which the machine is operating. In particular, the controller 100 is configured to adjust a position of the damper 30 based upon inputs from one or more of (i) a temperature sensor T2 associated with a ware inlet 32 of the housing (e.g., to detect temperature changes caused by spillover form the ware inlet), and/or (ii) a temperature sensor T1 associated with a ware outlet 34 of the housing (e.g., to detect temperature changes caused by spillover from the ware outlet), and/or (iii) a temperature sensor T3 along the vent path and/or (iv) an air flow and temperature sensor P4, T4 along the vent path 22.

The controller 100 is configured with different operating modes for the machine 10, including a start-up mode, a washing mode, an idle mode and a shutdown mode. The controller is configured such that, during each such mode, the controller implements a damper control logic that is particular to that mode.

During the startup mode, the controller 100 is configured to implement a startup damper control logic in which the controller operates such that the damper is initially substantially closed and the damper is moved to a more open position if either a temperature indicated by the temperature sensor T1 exceeds a set limit or a temperature indicated by the temperature sensor T2 exceeds a set limit. The two set limits may typically be the same. More specifically, a cold machine hard ducted to a room's vent and with all curtains in the right place while warming up from start will have damper 30/AV in the almost closed position, say at W % open. The damper is energized once the machine start button is pressed. During the warming process of the machine, if one or both of sensors T1 and T2 reads above a predetermined set temperature value Ta (indicating that hot moist air may begin exiting the machine), the controller 100 responsively regulates the damper 30/AV to partially open or open further to say V % open (where V %>W %) in order to both ensure reducing spillover of steam or heat from the machine to the room and avoid drawing an excessive amount of steam/heat from the machine through the building vent. This ensures the temperatures at both sensors T1 and T2 remain below a predetermined set value Ta. Temperature sensors T1 and T2 are regularly monitored during startup and, each time a reading above the set value Ta occurs in the course of the warming process, the controller regulates the damper 30/AV to open a bit more—say by increments of about M % (e.g., M %=5% or 7.5% or 10%) to ensure reducing steam or heat from the machine to the room. The damper will continue to open progressively as the machine gets warmer and warmer inside and is regulated to ensure that the temperatures proximate both sensors T1 and T2 are maintained below Ta during the startup.

During the washing mode, the controller 100 is configured to implement a washing damper control logic in which the controller 100 operates such that the damper is initially substantially opened and the damper 30/AV is moved to a more closed position if either a temperature indicated by the temperature sensor T1 falls below a set limit or a temperature indicated by the temperature sensor T2 falls below a set limit. The two set limits may typically be the same. More specifically, in the washing mode, which can occur after warm up so that the machine is ready to wash, and which is initiated by a photo eye 36 (or other sensor) detecting incoming wares. the controller initially opens the damper 30/AV to a fully open position to ensure that the hot moist air and steam generated as results of washing leaves through the vent, thereby reducing steam or heat spillover out of the machine via the inlet 32 and outlet 34, assuring that the temperatures indicated by sensors T1 and T2 are maintained below a set value Ta. If the temperature indicated by either sensor T1 or T2 becomes greater than Ta, the damper 30/AV will always be adjusted until fully opened. If the temperatures indicated by sensors T1 and T2 are far below the limit Ta, say at a limit Ta-Ts, the damper 30/AV is adjusted to a partially closed or more closed position to reduce heat exhausted via the vent of the machine. In addition, if the temperatures indicated by sensors T1 and/or T2 are persistently greater than limit Ta, even when the damper 30/AV is fully open, this could be a sign of curled/damaged curtains, misplaced curtains and/or a machine with unbalanced airflow. In the case of any such conditions, the controller 100 is configured to initiate an operator alert on an interface of the machine.

During the idle mode (no wares running through the machine), the controller 100 is configured to implement an idle damper control logic in which the controller operates such that if a temperature indicated by the temperature sensor T1 falls below a set limit, a temperature indicated by the temperature sensor T2 falls below a set limit and a temperature indicated by the temperature sensor T3 falls below a set limit, then the damper is moved to a more closed position. The set limits for sensors T1 and T2 may be the same, and the set limit for T3 may be different. In particular, a machine, after washing, will be in idle mode and will sense temperatures indicated by sensors T1, T2 and T3, as well as the airflow rate downstream of the damper 30/AV, as indicated by sensor P4. For a situation where temperatures indicated by sensor T1 and T2 are below a set limit Ta for a predetermined time "ta" while the temperature indicated by sensor T3 also drops below a predetermined value Tb for a predetermined time "tb", the damper 30/AV will be moved by the controller to a more closed position from its then existing position—say X % open to Y % open, where X %>Y %. With the damper 30/AV in its new partially open position, Y % open, if temperatures indicated by sensors T1 and T2 are again below Ta for a predetermined time ta1 while at the same time the temperature indicated by sensor T3 drops below a predetermined temperature value Tb for a predetermined time tb1, the damper 30/AV will be moved to an even more closed position, say Z % open, where X %>Y %>Z %. This will continue until the position of damper 30/AV closes fully or gets close to fully closing say W % open, where that X %>Y %>Z %>W %.

In addition, during idle mode, if the temperature indicated by sensor T3 is persistently greater than Tb, this could be a sign of widely opened sliders/doors in the machine which needs to be slightly closed or balanced. Also, it could indicate a float switch is stuck causing the heater in the tank(s) to be on at lower fluid levels. In the case of any such conditions, the controller 100 is configured to initiate an operator alert on an interface of the machine.

During the shutdown mode (draining and power down of machine), the controller 100 is configured to implement a shutdown damper control logic in which the controller 100 operates such that the damper 30/AV is moved initially to a substantially open position (e.g., 90% to 100% open) and, if both a temperature indicated by the temperature sensor T1 is below a set limit and a temperature indicated by the temperature sensor T2 is below a set limit, in both cases for at least some time period, the controller operates to move the damper 30/AV to a more closed position. The two set limits may typically be the same. In particular, once the power down button on the machine is pressed, the damper 30/AV will be moved to fully open to ensure heat in the machine leaves through the vent efficiently. During the shutdown process, sensors T1 and T2 will be monitored to ensure they are still below set limit Ta after a predetermine time "ts"—after which the damper 30/AV will be moved from fully open to a more closed position, e.g., from 100% open to P % open, where 100%>P %. The damper 30/AV will continue to progressively close until the temperatures indicated by sensors T1, T2 and T3 are close to the room temperature Tr, at which at that point in time the controller will adjust, or will have adjusted the damper 30/AV to near closed or substantially closed (e.g., adjusted to say W %, where 100%>P %>W %).

In addition to the above modes, some facilities do not have backflow preventers in the building vent system. During cold nights (typically in winter), if the temperature indicated by sensor T3 falls below a predetermined value Tw (e.g., Tw at or around 32° F. or 0° C.) for a predetermined time "tw", the controller 100 will fully close the damper 30/AV to protect the machine from the excessive cold. This is especially important in the case of machines with energy recovery coils along the machine vent path 22.

Other features could also be provided, per below.

Special Situations

T1, T2>Ta, or T1<Ta and T2>Ta, or T1>Ta and T2<Ta when damper 30/AV is fully open for a predetermined time while photo eye 36 is sensing wares (i.e., machine is washing). This situation could be a result of several factors including (1) bigger wares continuously passing through the machine or being washed.

T1, T2>Ta, or T1<Ta and T2>Ta, or T1>Ta and T2<Ta when damper 30/AV is fully opened for a predetermined time while photo eye is not sensing wares, where the predetermined time that assures, based on conveyer speed, that all wares should have exited the machine. This situation could be a result of several factors including big wares stuck in the machine when the machine is not washing, a problem with airflow through the machine, or misplaced and/or displaced curtains, etc.

Heat loss Q through the vent 22 is related to mass flow rate (M) of air through the vent (indicated by P4) and temperature difference (ΔT, indicated by the difference between temperature sensors T3 and T4) as in equation (1) below.

$$Q=MCp\Delta T \quad (1)$$

Using this equation, the controller 100 can control the damper 30/AV such that Q is always lower or equal to a specified acceptable energy loss Qa through the vent as in equation (2) below.

$$Q\leq Qa \quad (2)$$

If the product of M and ΔT could be such that the energy loss Qa through the vent is higher than the accepted energy loss Qa, as in equation (3) below, adjustment of the damper is made to bring Q back below Qa.

$$Q>Qa \quad (3)$$

Variation in room vent flow rate pulled from the machine (e.g., change cubic feet per minute (CFM) pulled) caused by changes in load on the vent fan could result in the flow rate changing the energy loss Qa. Accordingly, the controller 100 is configured such that both temperature and airflow are measured while controlling the damper 30/AV, to ensure Q is below a predetermined value (Qa).

Taking into account vent cross-sectional area, as well as the shape, which is mostly commonly circular or rectangular, an automatic butterfly or gate valve, respectively, will be good damper choices to control a vent's cfm on a machine.

Moreover, the automatic valve could be part of the machine, or installed on the room's vent system, in which case a connection between the vent system and machine is needed for proper control.

Various advantages are achieved by the above system, including saving energy and reducing heat loss to the room. Possible diagnostic and/or failure detection in the machine is also possible, indicating when a machine is malfunctioning or not properly dialed in, or indicating absence or misplacement of curtains. The system also enables preventive steps to avoid freezing and rupturing of features/components in the machine, such as energy recovery coils located along the vent paths on some machines.

As used herein, the term controller is intended to encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other control components, or a combination of some or all of the above, that carries out the control functions of the system.

Aspects of the described machine and method include those set forth in paragraphs A-P below.

A. A warewash machine, comprising: a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction; a vent path from the chamber leading to a vent outlet for connecting to a building ventilation system; a damper for controlling a flow area at a location along the vent path; and a controller connected to control a position of the damper, the controller configured to adjust a position of the damper based upon input from at least a first temperature sensor, wherein the first temperature sensor is located at one of (i) the ware inlet, (ii) the ware outlet or (iii) along the vent path.

B. The warewash machine of paragraph A, wherein the first temperature sensor is located at the ware inlet, wherein the machine includes a second temperature sensor at the ware outlet and a third temperature sensor along the vent path, wherein the controller is also configured to control the position of the damper based upon inputs from both the second temperature sensor and the third temperature sensor.

C. The warewash machine of paragraph A or B, further comprising: an air flow sensor located along the vent path; wherein the controller is also configured to control the position of the damper based upon input from the air flow sensor.

D. The warewash machine of one of paragraphs A-C, wherein the controller is configured to operate in a startup mode, a washing mode, an idle mode and a shutdown mode, wherein the controller is configured to (i) implement a first damper control logic during the startup mode, (ii) implement a second damper control logic during the washing mode, (iii) implement a third damper control logic during the idle mode and (iv) implement a fourth damper control logic during the shutdown mode.

E. The warewash machine of paragraph D wherein, in the first damper control logic, the controller is configured to operate such that the damper is initially substantially closed and the damper is moved to a more open position if either a temperature indicated by the first temperature sensor exceeds a set limit or a temperature indicated by the second temperature sensor exceeds a set limit.

F. The warewash machine of paragraph D or E wherein, in the second damper control logic, the controller is configured to operate such that the damper is initially substantially opened and the damper is moved to a more closed position if either a temperature indicated by the first temperature sensor falls below a set limit or a temperature indicated by the second temperature sensor falls below a set limit.

G. The warewash machine of one of paragraphs D-F wherein, in the third damper control logic, the controller is configured to operate such that, if a temperature indicated by the first temperature sensor falls below a set limit, a temperature indicated by the second temperature falls below a set limit and a temperature indicated by the third temperature sensor falls below a set limit, the damper is moved to a more closed position.

H. The warewash machine of one of paragraphs D-G wherein, in the fourth damper control logic, the controller is configured to operate such that the damper is moved initially to a substantially open position and, if both a temperature indicated by the first temperature sensor is below a set limit and a temperature indicated by the second temperature sensor is below a set limit, in both cases for at least some time period, the damper is moved to a more closed position.

I. The warewash machine of one of paragraphs A-H, wherein the controller is configured to operate the warewash machine in at least first and second different modes, and the controller is configured with at least a first damper control logic that is used during the first mode and a second damper control logic that is used during the second mode, the second damper control logic being different in some way than the first damper control logic.

J. The warewash machine of one of paragraphs B-I, wherein the controller is configured to move the damper to a fully closed position if a temperature indicated by the third temperature sensor indicates a freezing condition.

K. The warewash machine of paragraph J, wherein the freezing condition is defined when the temperature sensor indicated by the third temperature sensor is below a set level for at least a set time period.

L. A method of operating a warewash machine to reduce energy loss, wherein the warewash machine includes a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction, a vent path from the chamber leading to a vent outlet for connecting to a building ventilation system, a damper for controlling a flow area at a location along the vent path, and a first temperature sensor, wherein the first temperature sensor is located at one of (i) the ware inlet, (ii) the ware outlet or (iii) along the vent path, the method comprising: adjusting a position of the damper based upon a temperature indicated by the first temperature sensor.

M. The method of paragraph L, wherein the first temperature sensor is located at the ware inlet, wherein the machine further includes a second temperature sensor at the ware outlet and a third temperature sensor along the vent path, and the method includes adjusting the position of the damper based upon temperatures indicated by both the second temperature sensor and the third temperature sensor.

N. The method of paragraph L or M, wherein the machine includes an air flow sensor located along the vent path, and the method includes adjusting the position of the damper based upon input from the air flow sensor.

O. The method of one of paragraphs L-N, wherein the method includes (i) implementing a first damper control logic during a startup mode of the machine, (ii) implementing a second damper control logic during a washing mode of the machine, (iii) implementing a third damper control logic during an idle mode of the machine and (iv) implementing a fourth damper control logic during a shutdown mode of the machine, wherein each one of the first, second, third and fourth damper control logics is different in some way than the other ones of the first, second, third and fourth damper control logics.

P. A warewash machine, comprising: a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction; a vent path from the chamber leading to a vent outlet for connecting to a building ventilation system; a damper for controlling a flow area at a location along the vent path; and a controller connected to control a position of the damper, the controller configured to adjust a position of the damper based upon input from at least one temperature sensor that indicates a temperature condition proximate to at least one of the ware inlet, the ware outlet or along the vent path.

It is to be clearly understood that the above description is intended by way of illustration and example only, is not intended to be taken by way of limitation, and that other changes and modifications are possible.

What is claimed is:

1. A warewash machine, comprising:

a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction;

a vent path from the chamber leading to a vent outlet for connecting to a building ventilation system;

a damper for controlling a flow area at a location along the vent path;

a controller connected to control a position of the damper, the controller configured to adjust a position of the damper based upon input from at least a first temperature sensor, wherein the first temperature sensor is located (i) proximate to the ware inlet, (ii) proximate to the ware outlet or (iii) along the vent path.

2. The warewash machine of claim 1, wherein the first temperature sensor is located at the ware inlet, wherein the machine includes a second temperature sensor at the ware outlet and a third temperature sensor along the vent path, wherein the controller is also configured to control the position of the damper based upon inputs from both the second temperature sensor and the third temperature sensor.

3. The warewash machine of claim 2, further comprising:

an air flow sensor located along the vent path;

wherein the controller is also configured to control the position of the damper based upon input from the air flow sensor.

4. The warewash machine of claim 2, wherein the controller is configured to operate in a startup mode, a washing mode, an idle mode and a shutdown mode, wherein the controller is configured to (i) implement a first damper control logic during the startup mode, (ii) implement a second damper control logic during the washing mode, (iii) implement a third damper control logic during the idle mode and (iv) implement a fourth damper control logic during the shutdown mode.

5. The warewash machine of claim 4 wherein, in the first damper control logic, the controller is configured to operate such that the damper is initially substantially closed and the damper is moved to a more open position if either a temperature indicated by the first temperature sensor exceeds a set limit or a temperature indicated by the second temperature sensor exceeds a set limit.

6. The warewash machine of claim 5 wherein, in the second damper control logic, the controller is configured to operate such that the damper is initially substantially opened and the damper is moved to a more closed position if either a temperature indicated by the first temperature sensor falls below a set limit or a temperature indicated by the second temperature sensor falls below a set limit.

7. The warewash machine of claim 6 wherein, in the third damper control logic, the controller is configured to operate such that, if a temperature indicated by the first temperature sensor falls below a set limit, a temperature indicated by the second temperature falls below a set limit and a temperature indicated by the third temperature sensor falls below a set limit, the damper is moved to a more closed position.

8. The warewash machine of claim 7 wherein, in the fourth damper control logic, the controller is configured to operate such that the damper is moved initially to a substantially open position and, if both a temperature indicated by the first temperature sensor is below a set limit and a temperature indicated by the second temperature sensor is below a set limit, in both cases for at least some time period, the damper is moved to a more closed position.

9. The warewash machine of claim 2, wherein the controller is configured to move the damper to a fully closed position if a temperature indicated by the third temperature sensor indicates a freezing condition.

10. The warewash machine of claim 9, wherein the freezing condition is defined when the temperature sensor indicated by the third temperature sensor is below a set level for at least a set time period.

11. The warewash machine of claim 1, wherein the first temperature sensor is located proximate to the ware inlet or proximate to the ware outlet.

12. A method of operating a warewash machine to reduce energy loss, wherein the warewash machine includes a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction, a vent path from the chamber leading to a vent outlet for connecting to a building ventilation system, a damper for controlling a flow area at a location along the vent path, and a first temperature sensor, wherein the first temperature sensor is located at (i) the ware inlet, (ii) the ware outlet or (iii) along the vent path, the method comprising:

adjusting a position of the damper based upon a temperature indicated by the first temperature sensor.

13. The method of claim 12, wherein the first temperature sensor is located at the ware inlet, wherein the machine further includes a second temperature sensor at the ware outlet and a third temperature sensor along the vent path, and the method includes adjusting the position of the damper based upon temperatures indicated by both the second temperature sensor and the third temperature sensor.

14. The method of claim 13, wherein the machine includes an air flow sensor located along the vent path, and the method includes adjusting the position of the damper based upon input from the air flow sensor.

15. The method of claim 13, wherein the method includes (i) implementing a first damper control logic during a startup mode of the machine, (ii) implementing a second damper control logic during a washing mode of the machine, (iii) implementing a third damper control logic during an idle mode of the machine and (iv) implementing a fourth damper control logic during a shutdown mode of the machine, wherein each one of the first, second, third and fourth damper control logics is different in some way than the other ones of the first, second, third and fourth damper control logics.

16. The method of claim 12, wherein the first temperature sensor is located at the ware inlet or the ware outlet.

17. A warewash machine, comprising:

a housing defining a ware inlet, a ware outlet and an internal chamber running from the ware inlet to the ware outlet and through which wares are moved in a conveyance direction by a conveyor for cleaning, the internal chamber including a plurality of sequential spray zones including at least one wash zone and a rinse zone downstream of the wash zone in the conveyance direction;

a vent path from the chamber leading to a vent outlet for connecting to a building ventilation system;

a damper for controlling a flow area at a location along the vent path;

a controller connected to control a position of the damper, the controller configured to adjust a position of the damper based upon input from at least one temperature sensor that indicates a temperature condition proximate at least one of the ware inlet or the ware outlet, or along the vent path;

wherein the controller is configured to operate the warewash machine in at least first and second different modes, and the controller is configured with at least a first damper control logic that is used during the first mode and a second damper control logic that is used during the second mode, the second damper control logic being different in some way than the first damper control logic.

* * * * *